US008360246B2

(12) United States Patent
Bourke

(10) Patent No.: US 8,360,246 B2
(45) Date of Patent: Jan. 29, 2013

(54) FROTH FLOTATION METHOD AND AN APPARATUS FOR EXTRACTING A VALUABLE SUBSTANCE FROM A SLURRY

(75) Inventor: Peter Bourke, Perth (AU)

(73) Assignee: Outotec Oy, Espoo (FI)

( * ) Notice: Subject to any disclaimer, the term of this patent is extended or adjusted under 35 U.S.C. 154(b) by 0 days.

(21) Appl. No.: 13/377,525

(22) PCT Filed: Jun. 3, 2010

(86) PCT No.: PCT/FI2010/050456

§ 371 (c)(1),
(2), (4) Date: Dec. 9, 2011

(87) PCT Pub. No.: WO2010/142844

PCT Pub. Date: Dec. 16, 2010

(65) Prior Publication Data

US 2012/0074046 A1 Mar. 29, 2012

(30) Foreign Application Priority Data

Jun. 9, 2009 (AU) ..... 2009202281

(51) Int. Cl.

| | |
|---|---|
| ***B03D 1/14*** | (2006.01) |
| ***B03D 1/02*** | (2006.01) |
| ***B03D 1/16*** | (2006.01) |
| ***B03D 1/24*** | (2006.01) |

(52) U.S. Cl. ..... 209/164; 209/168; 209/169; 209/170

(58) Field of Classification Search ..... 209/164, 209/168, 169, 170

See application file for complete search history.

(56) References Cited

U.S. PATENT DOCUMENTS

| | | | | |
|---|---|---|---|---|
| 4,981,582 | A | 1/1991 | Yoon | |
| 5,039,400 | A * | 8/1991 | Kallioinen et al. | 209/164 |
| 5,511,669 | A * | 4/1996 | Bourke | 209/164 |
| 2004/0084354 | A1 | 5/2004 | Bourke | |
| 2008/0230447 | A1 | 9/2008 | Jameson | |

FOREIGN PATENT DOCUMENTS

WO WO 93/20945 A1 * 10/1993

OTHER PUBLICATIONS

Hetti Palonen, International Search Report for PCT/FI2010/050456, Sep. 29, 2010.

* cited by examiner

*Primary Examiner* — Thomas M Lithgow

(74) *Attorney, Agent, or Firm* — Chernoff Vilhauer McClung Stenzel LLP

(57) ABSTRACT

In a froth flotation method and apparatus an upwardly open circular trough (4) having outlets (5) on the outer periphery of the trough is arranged horizontally above the froth phase (F) so that the trough is coaxial with the flotation vessel (1), and said circular trough is rotated around its center axis. A stationary water pipe (6) is arranged above the trough (4). Fresh water (W) is fed via the water pipe (6) into the trough (4) while the trough is rotating, and the water is let to flow by gravity and centrifugal force from the trough (4) via the outlets (5) into the froth phase (F).

12 Claims, 5 Drawing Sheets

FROTH FLOTATION METHOD AND AN APPARATUS FOR EXTRACTING A VALUABLE SUBSTANCE FROM A SLURRY

This is a national stage application filed under 35 USC 371 based on International Application No. PCT/FI2010/050456 filed Jun. 3, 2010, and claims priority under 35 USC 119 of Australian Patent Application No. AU 2009202281 filed Jun. 9, 2009.

FIELD OF THE INVENTION

The present invention relates to a method and an apparatus for extracting a valuable substance from a slurry.

BACKGROUND OF THE INVENTION

Flotation is a three phase system of solids, water and air. The valuable minerals are usually made hydrophobic by addition of suitable reagents. Frother reagents are added to the slurry to stabilize bubbles and reduce surface tension at slurry surface so that bubble swarms do not coalesce and burst. Reagents referred to as collectors are added to the slurry to make the valuable particles hydrophobic so that they will attach to the dispersed air bubbles and slowly rise to form a stable froth zone at the cell surface.

Air is fed into the slurry in a flotation vessel to infuse and disperse bubbles into the slurry. When the particles of the valuable substance come into contact with the bubbles they are attached to the bubbles and rise upwards to the surface of the slurry to form a foam bed (herein called as a froth phase) above the free surface of the slurry (slurry phase). The froth can then be removed from the vessel by overflow over an overflow lip into the froth launder for further processing. A froth washing device has been arranged to disperse wash water into the froth phase in the flotation vessel before the overflow to wash out undesirable hydrophilic fine particles entrained from the slurry phase to the froth phase.

Flotation methods are described e.g. in prior art documents U.S. Pat. Nos. 7,328,806, 7,163,105, 6,793,069, 5,601,703, 5,814,210, 4,804,460, 2,756,877, 2,182,442, 2,369,401 and 1,952,727.

The prior art document, U.S. Pat. No. 1,952,727 discloses a method and apparatus in which water is applied to the froth by spray pipes which extend transversely of the flotation cell above the froth. The spray pipes are perforated in such a manner that fine streams or small droplets of water may be directed against the surface of the froth at points removed from the overflow lip. When a gentle spray of pure water is applied by the spray pipes, the water tends to pass downwardly through the layer of froth and in so doing it becomes substituted in the films of the bubbles with which it comes into contact for the liquid of which the films were originally formed. The displaced liquid together with the undesirable entrained gangue particles and other materials contained therein passes downwardly into the slurry body thereby increasing the quality of the concentrate flowing over the launder lip.

Such technology has been used for many years in both base metals and the coal industry to improve product quality. The majority of wash water devices transfer clean water into the froth zone of a flotation cell to remove entrained hydrophilic gangue particles (size <10 μm) that have no commercial value. The presence of these fine gangue particles can be a major factor in reducing the grade of the concentrate from the flotation circuit i.e. MgO minerals in Nickel concentrate, as or silica (ash content) in coal fines.

There are many wash water devices and these range from fine sprays located within the froth zone (e.g. U.S. Pat. Nos. 5,814,210, 5,167,798, 4,981,582) to a series of static perforated stainless steel water trays that sit above the froth and transfer water via a series of 3 mm diameter holes into the froth surface. This wash water penetrates the froth zone and slowly passes downwards through the froth layer by gravity and replaces the existing entrained water and fine hydrophilic gangue thus improving the overall quality of the froth concentrate.

The most common problems with the known technology has been the constant need for cleaning the blocked sprays and the conduits. The quality of wash water has always been a major issue in the industry and it is almost impossible to guarantee that a process disturbance will not occur that will result in the process water becoming dirty and contaminated with the fine solids. Also a lack of maintenance access to the flotation cells has long been an ongoing problem with static wash water trays. Hence there is a need for a device that can substantially ameliorate or overcome some or all of these problems with the prior art.

OBJECT OF THE INVENTION

The object of the present invention is to substantially ameliorate or overcome the above-mentioned drawbacks with the prior art.

Accordingly, it is an object of the present invention to effectively wash out the entrained fine hydrophilic gangue particles in the froth phase without blocking off effective access into the cell.

Another object of the present invention is to provide the flotation method and the apparatus in which the blocking of the wash water applying equipment and thereof resulting process interruptions can be avoided or at least substantially reduced when compared to the prior art.

Still another object of the invention is to improve the overall quality of the froth concentrate.

SUMMARY OF THE INVENTION

The foregoing and other objects are achieved in accordance with the present invention through the provision of a new and improved froth flotation method for extracting a valuable substance from a slurry comprising a mixture of solid phase, liquid phase and the valuable substance, the method including the steps of delivering gas into the slurry in a flotation vessel to infuse gas bubbles into the slurry; dispersing the gas bubbles into the slurry said gas bubbles capturing said valuable substance from the slurry and forming a stable froth phase above the slurry phase said froth phase to be removed from the vessel by overflow over an overflow lip into a froth launder, and dispersing wash water into the froth phase to wash out undesirable hydrophilic fine particles entrained from the slurry phase to the froth phase.

In accordance with the invention the method comprises steps of: arranging an upwardly open circular trough having a range of distribution outlets on the outer periphery of the trough horizontally above the froth phase so that the trough is coaxial with the flotation vessel, and said circular trough is rotated around its center axis; arranging a stationary water pipe above the trough; feeding fresh water via the water pipe into the trough while the trough is rotating; and distributing the wash water by gravity and centrifugal force from the trough via the distribution outlets into the froth phase.

Moreover, the invention concerns an apparatus for extracting a valuable substance from a slurry comprising a mixture of solid phase, liquid phase and the valuable substance. The apparatus comprises a flotation vessel having an inlet for feeding slurry into the flotation vessel, said vessel having an overflow lip. Further the apparatus comprises a gas dispersion mechanism for delivering gas into the slurry to infuse gas bubbles into the slurry said gas bubbles being for capturing said substance from the slurry and forming a stable froth phase above the slurry phase. A froth launder is arranged to receive froth flowing over the overflow lip for removing froth from the flotation vessel. Moreover, the apparatus comprises a froth washing device for dispersing wash water into the froth phase to wash out undesirable hydrophilic fine particles entrained from the slurry phase to the froth phase.

In accordance with the invention the froth washing device comprises an upwardly open circular trough having distribution outlets on the outer periphery, the trough being disposed horizontally above the froth phase. Further, the apparatus comprises a rotation means for rotating the circular trough around its center axis. A stationary water pipe is arranged above the trough for feeding fresh water into the trough. The wash water is able to flow from the trough via the distribution outlets into the froth phase by gravity and centrifugal force.

The froth washing device of the invention is applicable for all types of flotation cells including mechanically agitated cells, flotation columns, Microcel™ Microbubble Flotation columns (described in U.S. Pat. Nos. 4,981,582 and 5,167,798), and Jameson Cells (described in U.S. Pat. Nos. 5,188,726, 5,332,100 and 4,938,865).

The invention has the advantage that it makes it possible to effectively wash out the entrained fine hydrophilic gangue particles from the froth phase, and so that the blocking of the wash water applying equipment and thereof resulting process interruptions can be avoided or at least substantially reduced when this rotating device is used. The rotating trough allows the wash water to gravitate to the distribution outlet. There is also the effect of centrifugal force on the water outlets which helps pass any solid particles in the wash water. This system does not use sprays and therefore will not block up as quickly. Moreover, the invention improves the overall quality of the froth concentrate.

In an embodiment of the method water is constantly fed to the trough so that the water level in the trough is substantially constant to keep the hydrostatic pressure in the outlets substantially constant.

In an embodiment of the method wash water is fed from the trough into the froth phase via a plurality of openings arranged along the length of at least one distribution conduit which is connected to the outlet of the trough.

In an embodiment of the method a rotating froth removal device having a front face and a rear face is at least partly immersed into the froth phase for removal of the froth from the flotation vessel to the froth launder with a centrifugal force generated by the rotating froth removal device. The froth removal device is rotated at the same speed and along with the distribution conduit in close vicinity of the distribution conduit so that wash water can flow from the openings of the distribution conduit down onto and along the rear face of the froth removal device and further down into the froth phase.

In an embodiment of the method the wash water is fed from the openings arranged along the length of at least one distribution conduit to an upwardly open tray divided with baffles in the lengthwise direction of the tray into separate compartments, said tray having a base, and said base having a group of trough holes in each compartment through which holes wash water can fall into the froth.

In an embodiment of the apparatus the froth washing device comprises at least one distribution conduit which is connected to the outlet of the rotating trough, the distribution conduit having a plurality of openings arranged along its length to distribute wash water from the trough into the froth phase.

In an embodiment of the apparatus the apparatus comprises a rotating froth removal device having a front face and a rear face, said froth removal device being disposed to at least partly being immersed into the froth phase for removal of the froth from the flotation vessel to the froth launder with a centrifugal force generated by the rotating froth removal device. Further, the apparatus comprises means for rotating the froth removal device at the same speed and along with the distribution conduit in close vicinity with the distribution conduit so that wash water is allowed to flow from the openings of the distribution conduit down onto and along the rear face of the froth removal device and further down into the froth phase.

In an embodiment of the apparatus the apparatus comprises an upwardly open tray which is arranged below the distribution conduit for receiving wash water from the openings, said tray including a base having a group of through holes, and baffles arranged inside the tray to divide the tray into separate compartments in the lengthwise direction of the tray.

In an embodiment of the apparatus the apparatus comprises a bridge extending over the flotation vessel. The rotation means for rotating the trough comprise a slewing ring having a first ring fixedly connected to the underside of the bridge, and a second ring which is bearing-mounted to the first ring for rotation in relation of the first ring and to which second ring the trough is fixedly connected, said second ring being driven by a motor.

In an embodiment of the apparatus the second ring comprises a cogged rim which is meshing with a cog wheel, said cog wheel being driven by the motor.

In an embodiment of the apparatus the froth removal device is fixedly connected with respect to the second ring of the slewing ring.

Any suitable rotating means for rotating the trough can be used. E.g. a belt drive or a "jockey pulley" system could be used to effect rotation of the trough. It could also be done from the side of the cell at the perimeter using a tyre and a rail.

BRIEF DESCRIPTION OF THE DRAWINGS

The accompanying drawings, which are included to provide a further understanding of the invention and constitute a part of this specification, illustrate embodiments of the invention and together with the description help to explain the principles of the invention. In the drawings.

DETAILED DESCRIPTION OF THE INVENTION

Figure 1:
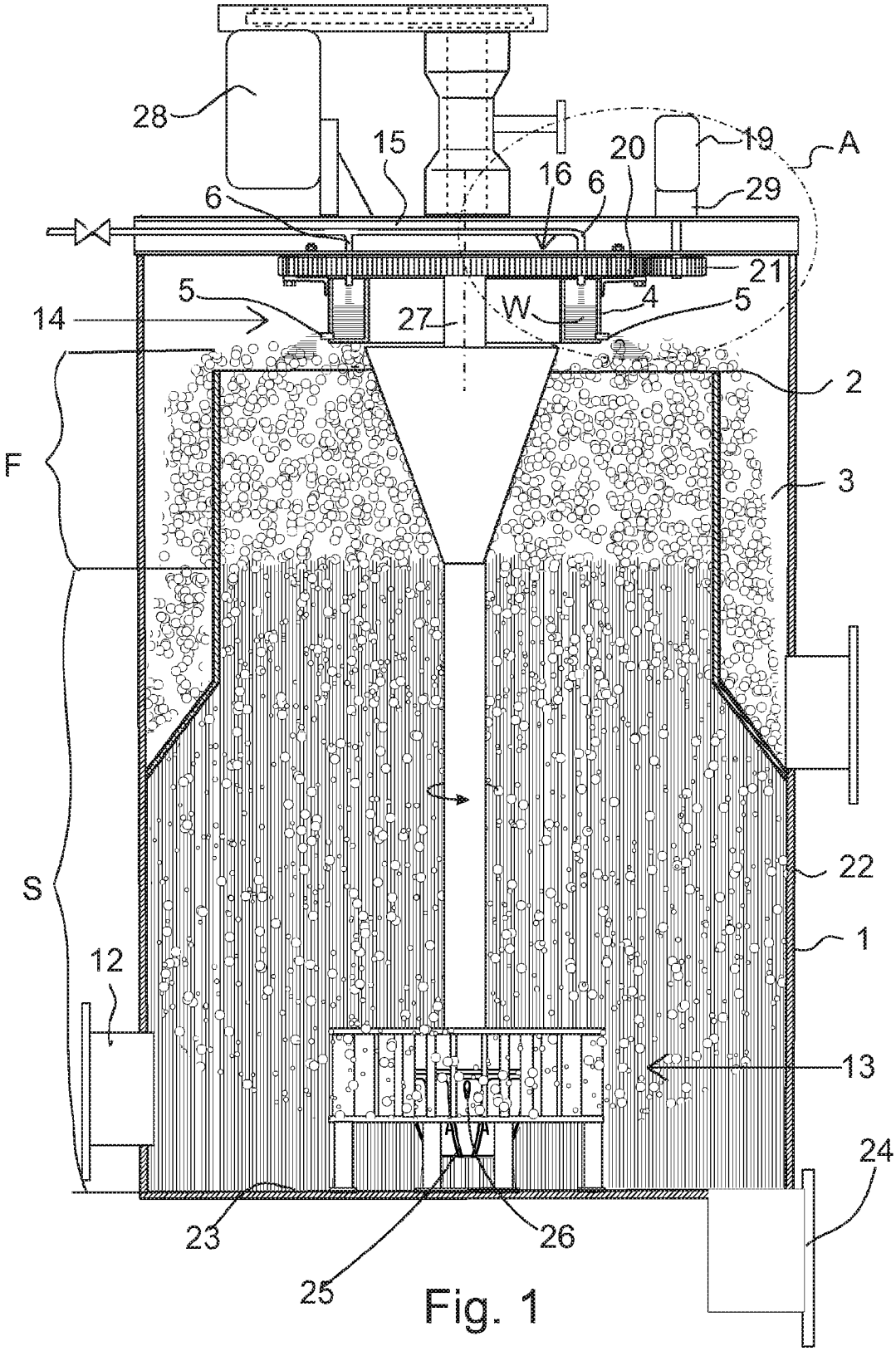
FIG. 1 is a diagrammatic view in vertical section of a first embodiment of the froth flotation apparatus of the invention.

FIG. 1 shows a froth flotation apparatus configured to process slurry in order to extract a valuable substance, such as minerals, from the slurry.

The flotation apparatus comprises flotation vessel 1 formed by a cylindrical side wall 22 and a bottom wall 23. The inlet 12 is arranged at the side wall 22 for feeding slurry into the vessel 2. The apparatus also includes an outlet 24 for discharging the processed slurry and sludge. The apparatus further includes gas dispersion mechanism 13 arranged to feed gas, for example air, into the slurry to infuse gas bubbles into the slurry. In FIG. 1 the slurry and the slurry phase S are shown with vertical hatching. The bubbles rise above the surface of the slurry phase S to form a froth phase F.

In this example of the flotation apparatus the gas dispersing mechanism 13 includes a gas dispersing rotor 25 having gas ducts 26 for dispersing gas into the slurry. The gas dispensing rotor 25 is arranged to rotate in the vicinity of the bottom 23 of the flotation vessel 1. The rotor 25 is connected via vertical rotation axle 27 to power means 28, such as an electric motor, which is arranged to rotate the rotation axle 27. The rotation axle 27 is a hollow tube for guiding flotation gas to the rotor 25. The rotor 25 agitates the slurry and simultaneously feeds gas to form the bubbles.

It should be noted that the invention is not limited to the gas dispersing mechanism shown in FIG. 1. The gas dispersing mechanism can be any known suitable gas dispersing mechanism which is able to form gas bubbles to the slurry.

In the upper portion of the vessel 1, at the region where the froth phase F is formed, the vessel has an overflow lip 2 over which the froth can flow to a froth launder 3 and be transferred from the flotation vessel for further processing.

Figure 2:
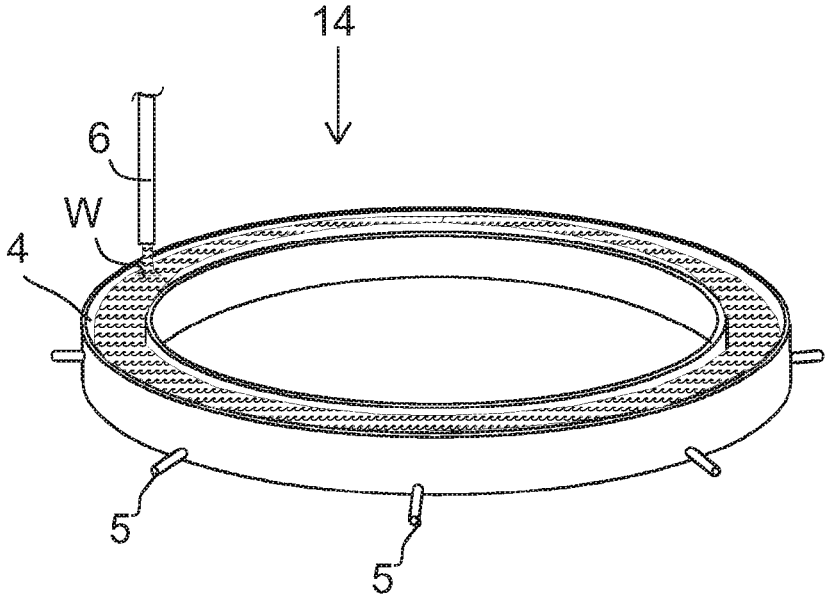
FIG. 2 is a diagrammatic perspective view of the froth washing device of the flotation apparatus of FIG. 1.
Figure 3:
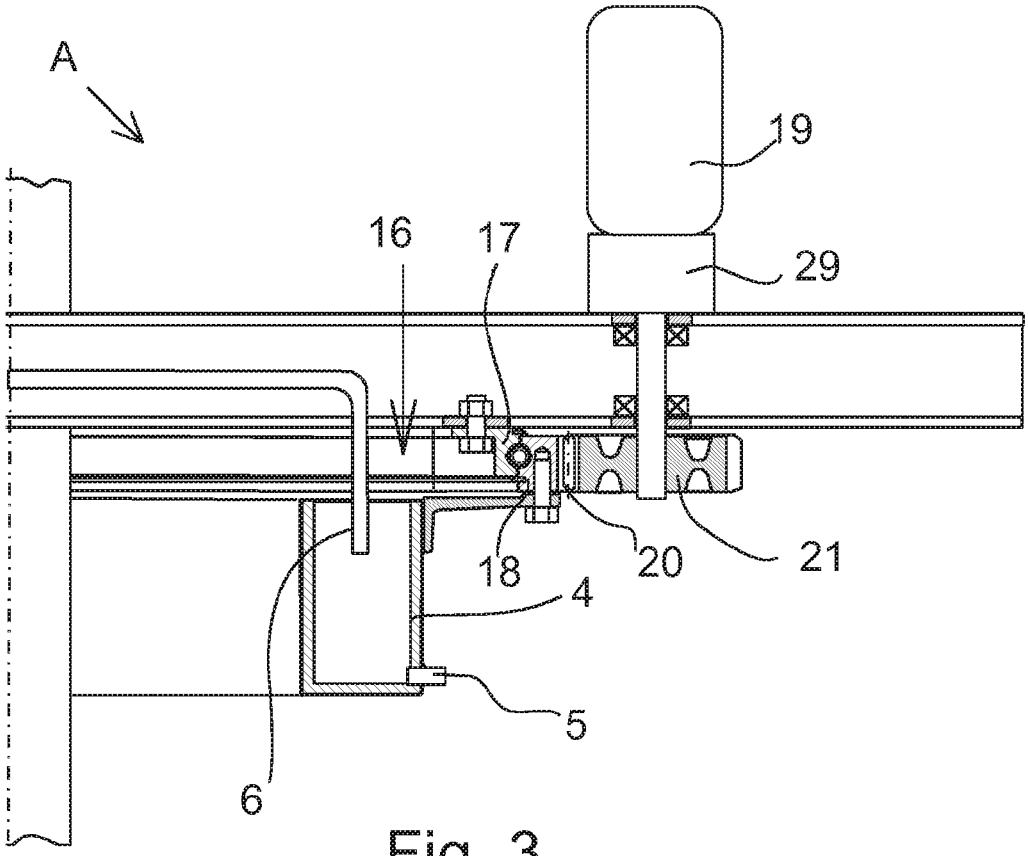
FIG. 3 is an enlarged sectional view of detail A of FIG. 1.

With reference to FIGS. 1 and 2 the apparatus comprises a froth washing device 14 for dispersing wash water into the froth phase F in the flotation vessel before the overflow to wash out undesirable hydrophilic fine particles entrained from the slurry phase to the froth phase. The froth washing device 14 comprises an upwardly open circular trough 4. The trough 4 has distribution outlets 5 on the outer periphery of the trough 4. The number of the outlets 5 can be 2 to 8. The trough 4 is located horizontally above the froth phase F and coaxially with the flotation vessel 1. The trough 4 is connected to a slewing ring 16. As shown in more detail in FIG. 3. The slewing ring 16 includes a first ring 17 which is bolted to the underside of the bridge 15 which extends over the flotation vessel 1 and is supported by the upper end of the vessel 1. A second ring 18 is bearing-mounted to the first ring to be rotatable in relation of the first ring 17. The trough 4 is bolted to the second ring 18. The second ring 18 has a cogged rim 20 which is meshing with a cog wheel 21. The cog wheel 21 is driven by an electric motor 19 via a reduction gear 29. This could also be done using a belt drive or other suitable mechanical device.

A stationary water pipe 6 is arranged above the trough 4. Fresh water W is continuously fed via the water pipe 6 into the trough 4 while the trough is rotating so that the water level in the trough is kept substantially constant in order to keep the hydrostatic pressure in the outlets 5. Thereby the outflow rate of the wash water from the plurality of outlets 5 on the outer periphery of the trough is kept substantially constant when the water is let to flow by gravity and centrifugal force from the trough 4 via the outlets 5 into the froth phase F.

In some other embodiment, instead of the slewing ring, one could support the trough using an extended beam and rotate the trough using a perimeter wheel and track located or attached to vessel wall.

Figure 4:
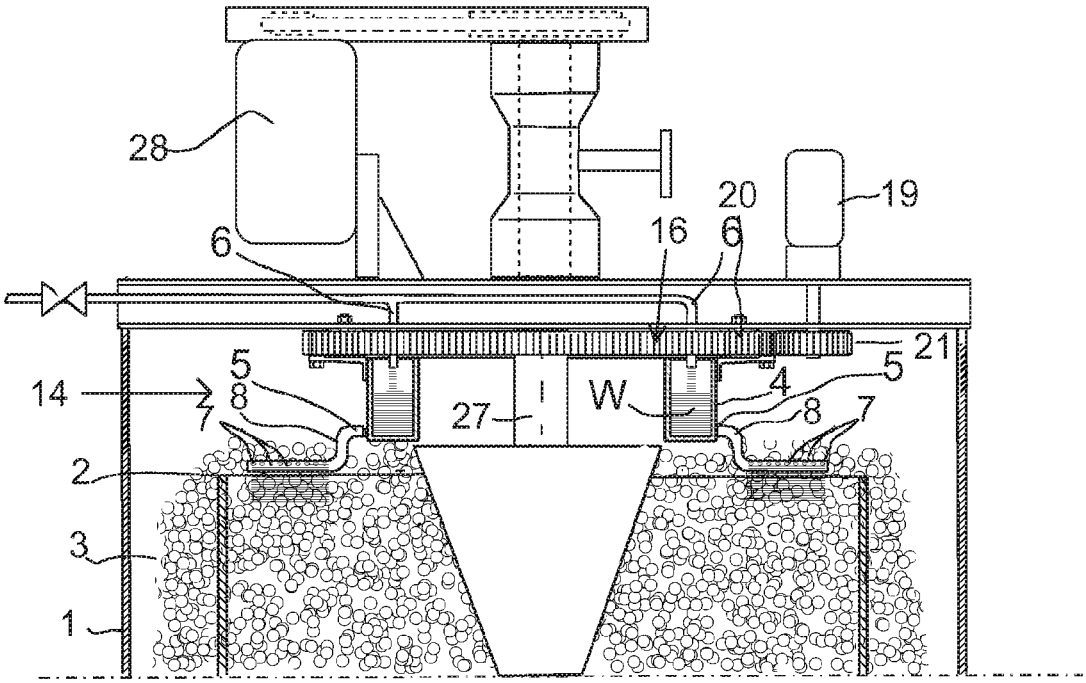
FIG. 4 is a diagrammatic view in vertical section of the upper part of a second embodiment of the froth flotation apparatus of the invention.
Figure 5:
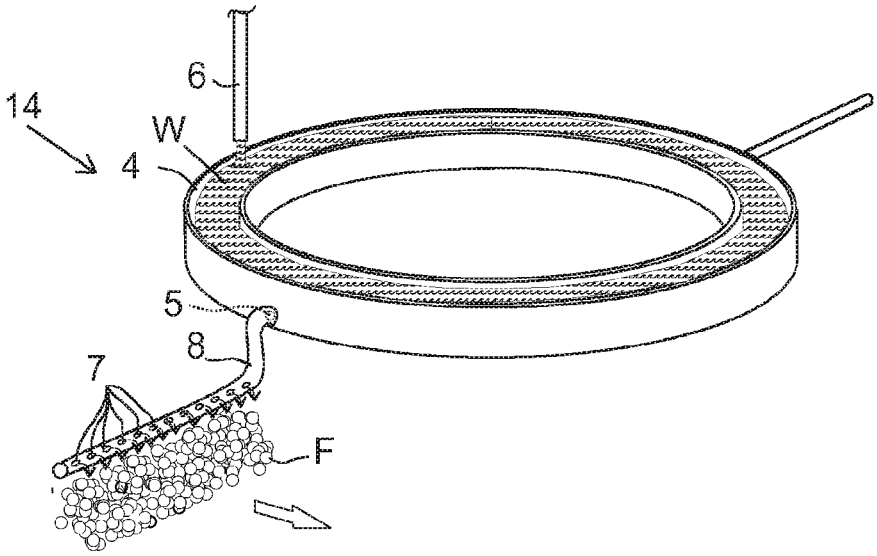
FIG. 5 is a diagrammatic perspective view of the froth washing device of the flotation apparatus of FIG. 4.

FIGS. 4 and 5 show a further development of the washing device 14 that comprises distribution conduits 8. Each distribution conduit 8 is connected to a respective outlet 5 of the trough 4. The distribution conduit 8 has a row of openings 7 arranged along its length to feed wash water from the trough 4 into the froth phase.

Figure 6:
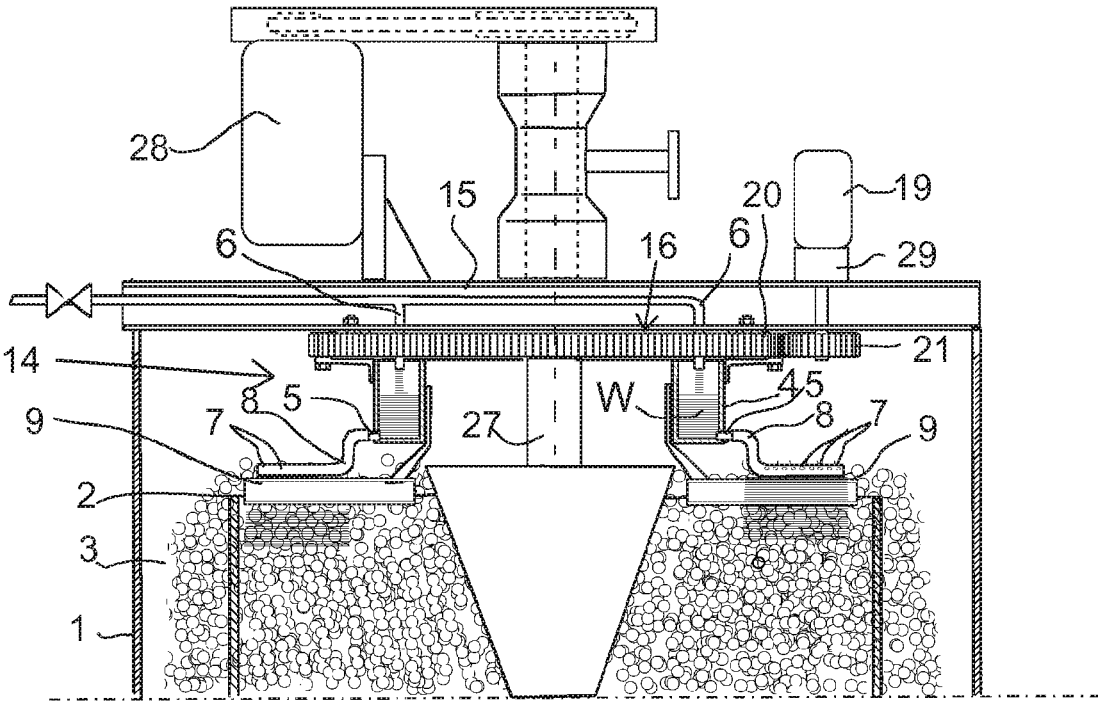
FIG. 6 is a diagrammatic view in vertical section of the upper part of a third embodiment of the froth flotation apparatus of the invention.
Figure 7:
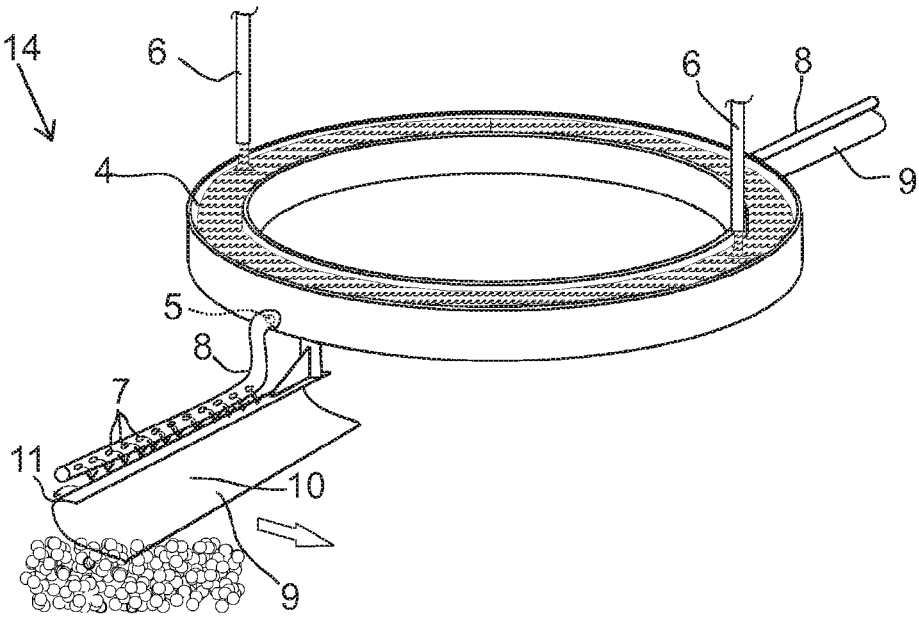
FIG. 7 is a diagrammatic perspective view of the froth washing device of the flotation apparatus of FIG. 6, and FIG. 8 show a perspective view of the froth washing device of the fourth embodiment of the froth flotation apparatus of the invention.

FIGS. 6 and 7 show a preferred embodiment of the apparatus. The apparatus comprises a rotating froth removal device 9, for example a froth cutter such as the one described in WO 02/49768 A1. The froth removal devices 9 are disposed to at least partly being immersed into the froth phase F for removal of the froth from the flotation vessel 1 to the froth launder 3 with a centrifugal force generated by the rotating froth removal device 9. Also in this embodiment the froth washing device 14 comprises distribution conduits 8 which are connected to the outlets 5 of the rotating trough 4. The distribution conduit 8 has a plurality of openings 7 arranged along its length to distribute wash water from the trough 4 into the froth phase. Rotating froth removal devices 9 each of them having a front face 10 and a rear face 11 are connected to the trough 4 or to the rotating second ring 18 to be rotated at the same speed and along with the trough 4 in close vicinity with the distribution conduit 8 so that wash water is allowed to flow from the openings 7 of the distribution conduit 8 down onto and along the rear face 11 of the froth removal device and further down into the froth phase F. As in the shown example of FIG. 7, the froth removal device 9 can be curved so that the front face 10 is concave and the rear face 11 is convex, or in some other embodiment (not shown in Figures) both faces 10, 11 can be planar whereby the froth removal device 10 is a straight blade arranged at a suitable angle, or it can be curved. The froth removal device 9 can normally be at the same level as the overflow lip 2, or it could be below, and/or it can extend partially over the froth lip.

Figure 8:
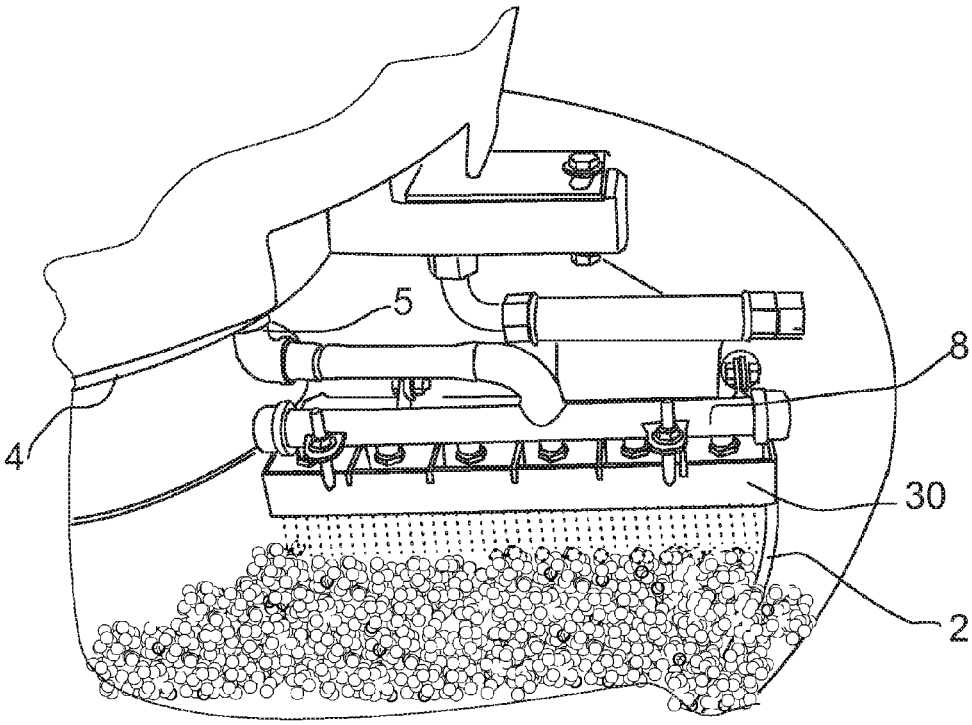
Figure 9:
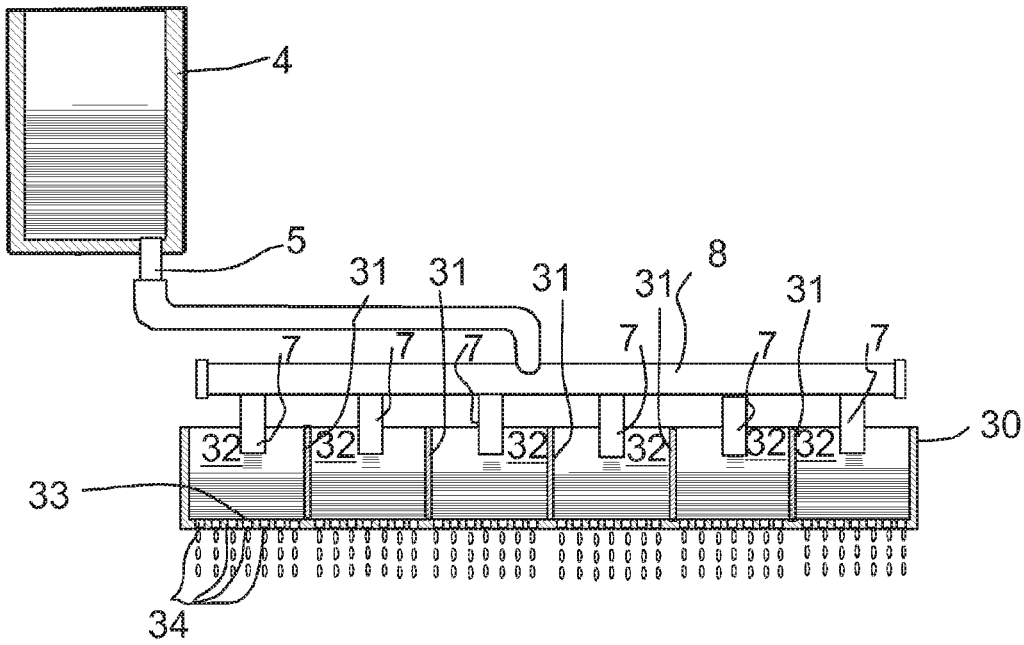
FIG. 9 shows a diagrammatic section of the froth washing device of FIG. 8.

FIGS. 8 and 9 show a further example of the apparatus. In FIGS. 8 and 9 can be seen that the distribution conduit 8 with a plurality of openings 7 arranged along its length is connected to the outlet 5 of the rotating trough 4. An upwardly open tray 30 is arranged below the distribution conduit 8 to receive wash water flowing from the openings 7 of the distribution conduit 8. The tray 30 includes a base 33 having a group of through holes 34. Baffles 31 are arranged inside the tray 30 to divide the tray into separate compartments 32 in the lengthwise direction of the tray. The holes 34 have a diameter of about 3 mm so that wash water can fall into the froth as a continuous flow of narrow streams and/or small droplets.

It is obvious to a person skilled in the art that with the advancement of technology, the basic idea of the invention may be implemented in various ways. The invention and its embodiments are thus not limited to the examples described above, instead they may vary within the scope of the claims.

In the claims which follow and in the preceding description of the invention, except where the context requires otherwise due to express language or necessary implication, the word "comprise" or variations such as "comprises" or "comprising" is used in an inclusive sense, i.e. to specify the presence of the stated features but not to preclude the presence or addition of further features in various embodiments of the invention.

It is to be understood that, if any prior art publication is referred to herein, such reference does not constitute an admission that the publication forms a part of the common general knowledge in the art, in Australia or any other country.

The invention claimed is:

1. A froth flotation method for extracting a valuable substance from a slurry (S) comprising a mixture of solid phase, liquid phase and the valuable substance, the method including the steps of delivering gas into the slurry (S) in a flotation vessel (1) to infuse gas bubbles into the slurry;

dispersing the gas bubbles into the slurry said gas bubbles capturing said valuable substance from the slurry and forming a froth phase (F) above the slurry phase said froth phase to be removed from the vessel by overflow over an overflow lip (2) into a froth launder (3), and dispersing wash water (W) into the froth phase (F) to wash out undesirable hydrophilic fine particles entrained from the slurry phase to the froth phase, characterized by the steps of arranging an upwardly open circular trough (4) having a range of distribution outlets (5) on the outer periphery of the trough horizontally above the froth phase (F) so that the trough is coaxial with the flotation vessel (1), and said circular trough is rotated around its center axis, arranging a stationary water pipe (6) above the trough (4), feeding fresh water (W) via the water pipe (6) into the trough (4) while the trough is rotating, and distributing the wash water by gravity and centrifugal force from the trough (4) via the distribution outlets (5) into the froth phase (F).

2. The method of claim 1, characterized in that water(W) is constantly fed to the trough (4) so that the water level in the trough is substantially constant to keep the hydrostatic pressure in the outlets (5) substantially constant.

3. The method of claim 1, characterized in that the wash water is fed from the trough (4) into the froth phase (F) via a plurality of openings (7) arranged along the length of at least one distribution conduit (8) which is connected to the outlet (5) of the trough (4).

4. The method of claim 3, characterized in that a rotating froth removal device (9) having a front face (10) and a rear face (11) is at least partly immersed into the froth phase (F) for removal of the froth from the flotation vessel (1) to the froth launder with a centrifugal force generated by the rotating froth removal device (9), and the froth removal device (9) is rotated at the same speed and along with the distribution conduit (8) in close vicinity of the distribution conduit so that wash water can flow from the openings (7) of the distribution conduit down onto and along the rear face (11) of the froth removal device and further down into the froth phase (F).

5. The method of claim 3, characterized in that the wash water is fed from the openings (7) arranged along the length of at least one distribution conduit (8) to an upwardly open tray (30) divided with baffles (31) in the lengthwise direction of the tray into separate compartments (32), said tray having a base (33), and said base having a group of trough holes (34) in each compartment through which holes wash water can fall into the froth.

6. An apparatus for extracting a valuable substance from a slurry (S) comprising a mixture of solid phase, liquid phase and the valuable substance, the apparatus comprising:

a flotation vessel (1) having an inlet (12) for feeding slurry into the flotation vessel, said vessel having an overflow lip (2);

a gas dispersion mechanism (13) for delivering gas into the slurry to infuse gas bubbles into the slurry said gas bubbles being for capturing said substance from the slurry and forming a froth phase (F) above the slurry phase (S);

a froth launder (3) to receive froth flowing over the overflow lip (2) for removing froth from the flotation vessel, and a froth washing device (14) for dispersing wash water into the froth phase (F) to wash out undesirable hydrophilic fine particles entrained from the slurry phase to the froth phase, characterized in that the froth washing device (14) comprises:

an upwardly open circular trough (4) having distribution outlets (5), the trough being disposed horizontally above the froth phase (F), rotation means for rotating the circular trough (4) around its center axis, and a stationary water pipe (6) above the trough (4) for feeding fresh water (W) into the trough, whereby the wash water is able to flow from the trough via the distribution outlets into the froth phase by gravity and centrifugal force.

7. The apparatus of claim 6, characterized in that the froth washing device (14) comprises at least one distribution conduit (8) which is connected to the outlet (5) of the rotating trough (4), the distribution conduit (8) having a plurality of openings (7) arranged along its length to distribute wash water from the trough (4) into the froth phase.

8. The apparatus of claim 7, characterized in that the apparatus comprises a rotating froth removal device (9) having a front face (10) and a rear face (11), said froth removal device being disposed to at least partly being immersed into the froth phase (F) for removal of the froth from the flotation vessel (1) to the froth launder (3) with a centrifugal force generated by the rotating froth removal device (9), and means for rotating the froth removal device (9) at the same speed and along with the distribution conduit (8) in close vicinity with the distribution conduit so that wash water is allowed to flow from the openings (7) of the distribution conduit down onto and along the rear face (11) of the froth removal device and further down into the froth phase (F).

9. The apparatus of claim 7, characterized in that the apparatus comprises an upwardly open tray (30) which is arranged below the distribution conduit (8) for receiving wash water from the openings (7), said tray including a base (33) having a group of through holes (34), and baffles (31) arranged inside the tray (30) to divide the tray into separate compartments (32) in the lengthwise direction of the tray.

10. The apparatus of claim 6, characterized in that the apparatus comprises a bridge (15) extending over the flotation vessel (1); and that the rotation means for rotating the trough (4) comprise a slewing ring (16) having a first ring (17) fixedly connected to the underside of the bridge (15), a second ring (18) which is bearing-mounted to the first ring for rotation in relation of the first ring and to which second ring the trough (4) is fixedly connected, said second ring being driven by a motor (19).

11. The apparatus of claim 10, characterized in that the second ring (18) comprises a cogged rim (20) which is meshing with a cog wheel (21), said cog wheel being driven by the motor (19).

12. The apparatus of claim 10, characterized in that the froth removal device (9) is fixedly connected with respect to the second ring (18) of the slewingring (16).

* * * * *